US005259826A

United States Patent [19]

Woods

[11] Patent Number: 5,259,826

[45] Date of Patent: Nov. 9, 1993

[54] METHOD OF FIXING A TAB AND/OR APPARATUS THEREFOR

[76] Inventor: Derrick J. Woods, 27 Ngaio Road, Bunnythorpe, Feilding, New Zealand

[21] Appl. No.: 904,182

[22] Filed: Jun. 25, 1992

[30] Foreign Application Priority Data

Jun. 28, 1991 [NZ] New Zealand ..... 238788

[51] Int. Cl.[5] ..... B65C 5/06; B65C 11/02

[52] U.S. Cl. ..... 493/325; 493/376; 227/21; 227/39; 156/DIG. 22; 156/DIG. 49

[58] Field of Search ..... 493/320, 324, 325, 345, 493/348, 351, 375, 376; 227/21, 39, 76, 156; 156/DIG. 22, DIG. 49

[56] References Cited

U.S. PATENT DOCUMENTS

| | | | |
|---|---|---|---|
| 2,720.821 | 10/1955 | Linnemann et al. | 493/325 |
| 2,742.828 | 4/1956 | Braun | 493/325 |
| 2,748.676 | 6/1956 | Braun | 493/325 |
| 3,861.280 | 1/1975 | Sato | 493/325 |
| 4,058.051 | 11/1977 | Sato | 493/325 |
| 5,014.896 | 5/1991 | Reitmeier et al. | 227/39 |

FOREIGN PATENT DOCUMENTS

| | | |
|---|---|---|
| 1407368 | 9/1975 | United Kingdom . |
| 1450532 | 9/1976 | United Kingdom . |

*Primary Examiner*—William E. Terrell

*Attorney, Agent, or Firm*—Blakely, Sokoloff, Taylor & Zafman

[57] ABSTRACT

Apparatus for cutting a tab from a strip of material and fixing the tab to a fixing surface. The apparatus has a housing and a driving head associated with the housing which is operable to drive a penetrating fastener into a fixing surface. A strip of material is fed by a feed mechanism to a cutter such that a portion of the strip can be cut by the cutter to form a tab. The portion of the strip to form the tab is presented to a position where it can be brought into contact with the fixing surface and fixed thereto by impact delivery of the penetrating fastener. Fixing of the portion of the strip can take place prior to or in conjunction with the portion being cut from the strip by the cutter. The apparatus can include a printer to apply indicia to the strip.

17 Claims, 7 Drawing Sheets

METHOD OF FIXING A TAB AND/OR APPARATUS THEREFOR

This invention relates to methods of fixing a tab to a fixing surface and/or apparatus therefor.

The present invention may be applied in areas where it is necessary to fix a durable tab or label to products that in the course of handling or use are exposed to adverse conditions. The invention has also a broader application by associating a reinforcing application tab with a stapling fastening means and thereby can have utilization in fixing, for example, insulation or building paper.

Accordingly, in one aspect the invention may broadly be said to consist in a method of fixing a tab to a fixing surface, said method comprising the steps of delivering or feeding from a strip of material a required length to form a said tab, cutting a portion of the strip to form a tab and prior to, simultaneously with or following said cutting fixing the cut portion to the fixing surface using a penetrating fastening means.

The method may incorporate the step of preprinting information on the tab and/or adding printed information programmable or controllable by an operator such that said printed information is added to the strip in conjunction with said feeding, cutting and fastening of said tab portion.

In a further aspect the invention may broadly be said to consist in apparatus comprising a housing, means associated with said housing and operable to deliver a penetrating fastening means into an article or structure providing a surface to which tab is to be fastened, feed means to feed a strip of material from which the tab is to be cut, cutting means to separate the tab from the strip and means to present the tab to a position where it can be brought into contact with the surface and by impact contact of a said penetrating fastening means by said means to deliver to fasten the tab to said surface.

The apparatus would preferably be constructed so that it is associated with a conventional fastening means used to deliver a staple or other penetrating fastening into a product. Thus the invention could be associated with a pneumatically operated stapling gun or other similar fastening means. The arrangement could be such as to apply two or more staples or other fastening means at the same time.

Alternatively the apparatus could have a fastening means formed from an impact action by implanting a part of the tab in a support surface such as a piece of timber.

Preferably the tab cutting means incorporates a shearing and impact action to perform a clean cut through tough plastics material with the cutting section of the stroke occupying a smaller movement towards the end of the stroke, thereby leaving a maximum time in the operating sequence for the strip to proceed through its advancement to deliver the prescribed length to be cut off as a tab.

Figure 1:
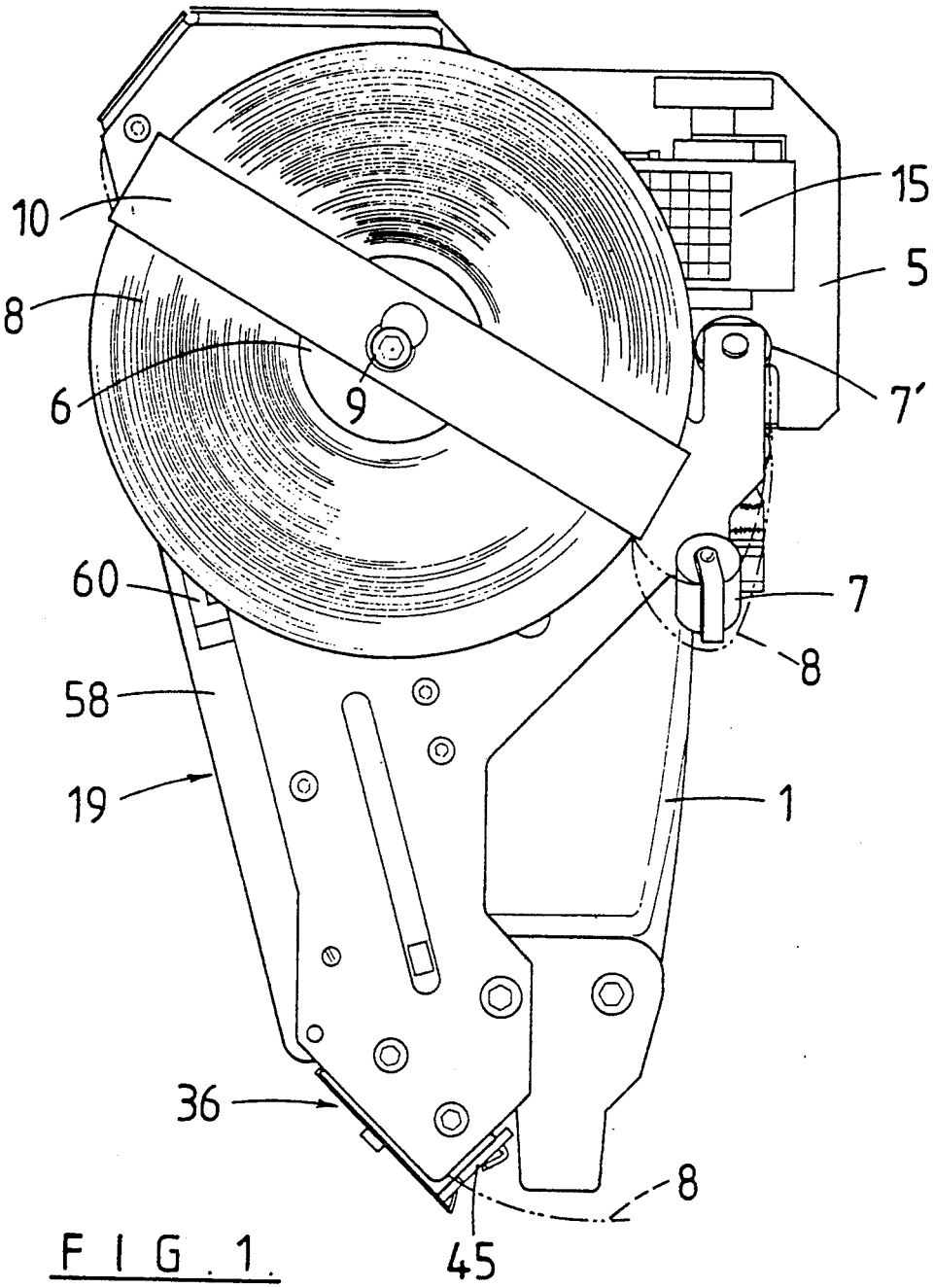
Figure 2:
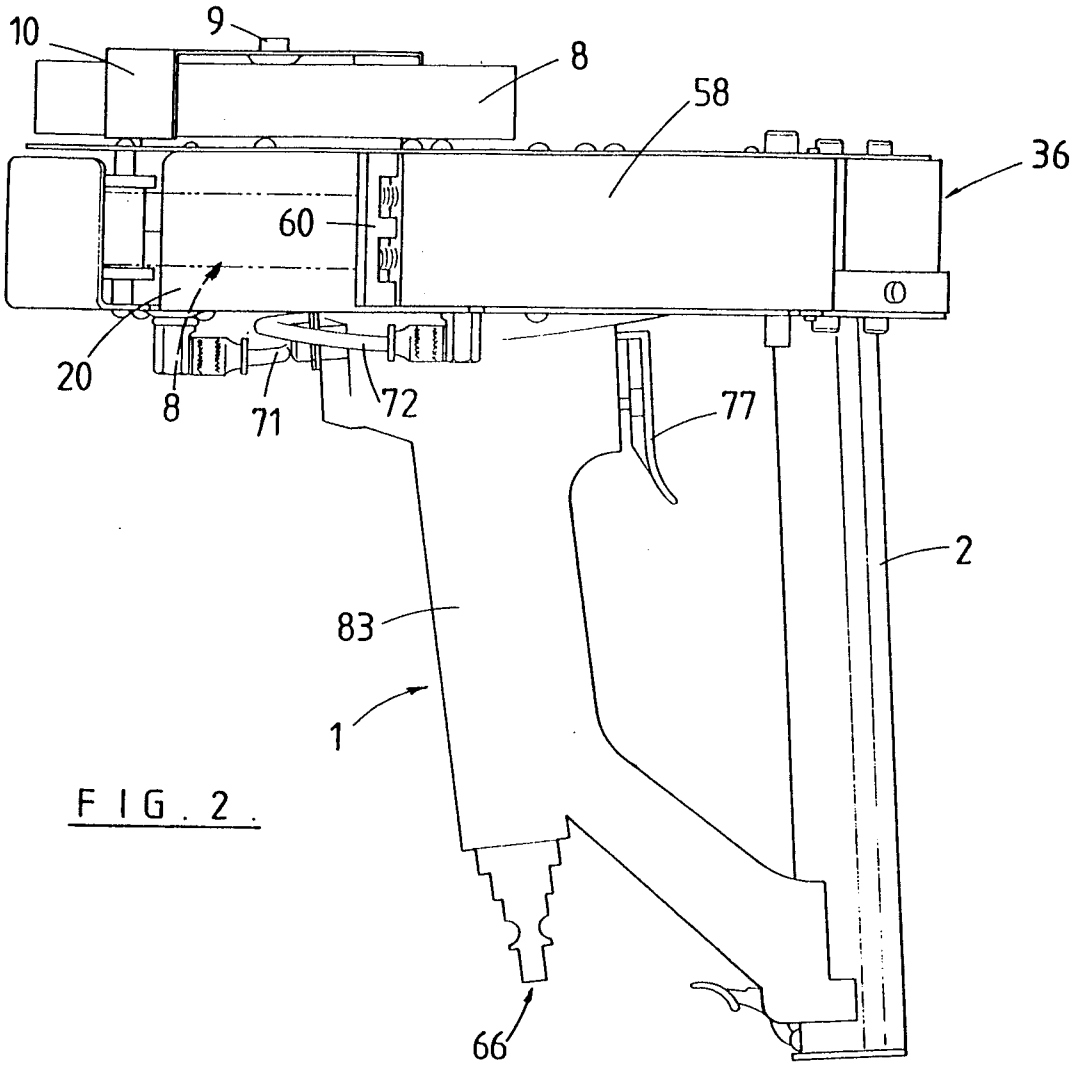
Figure 3:
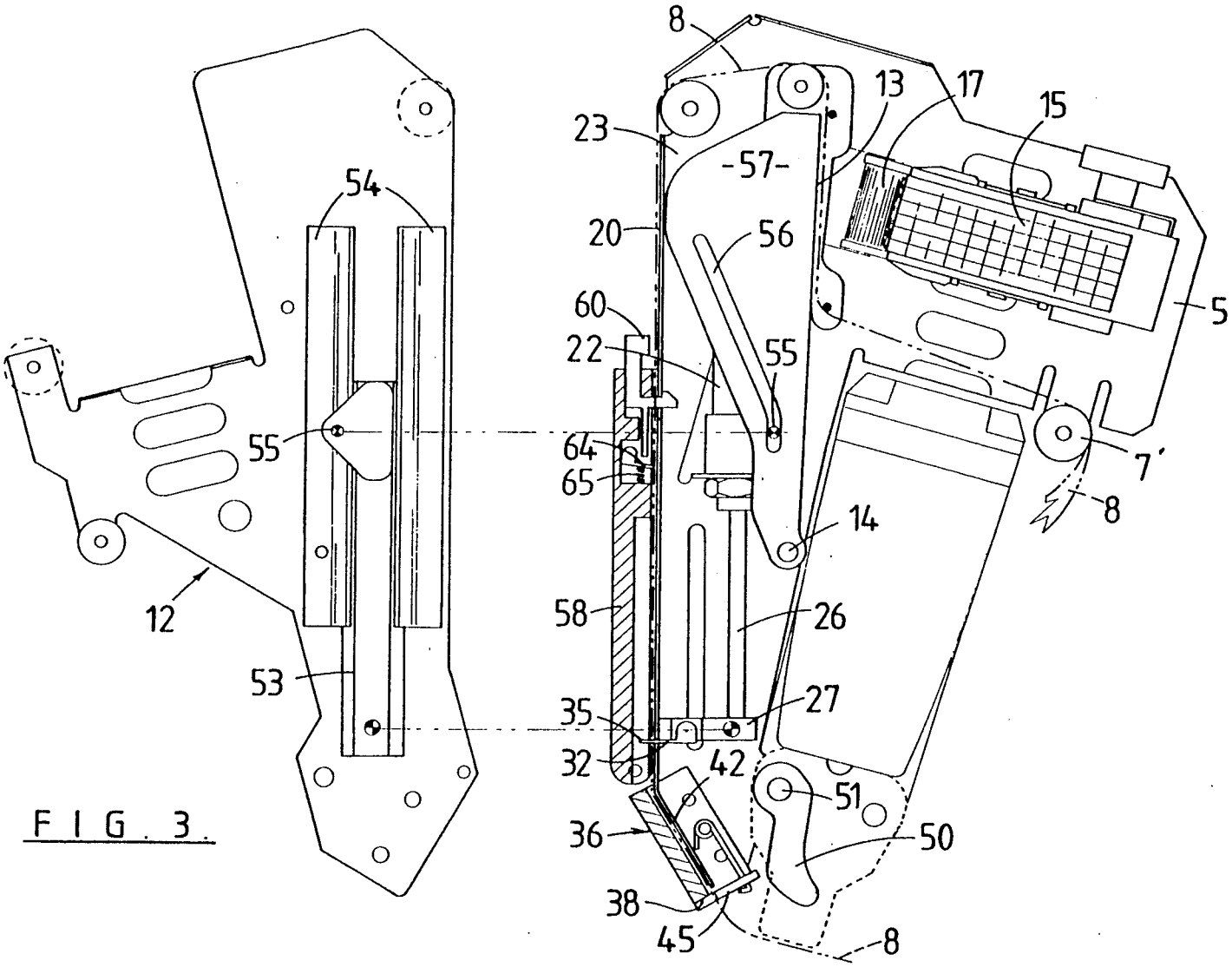
Figure 4:
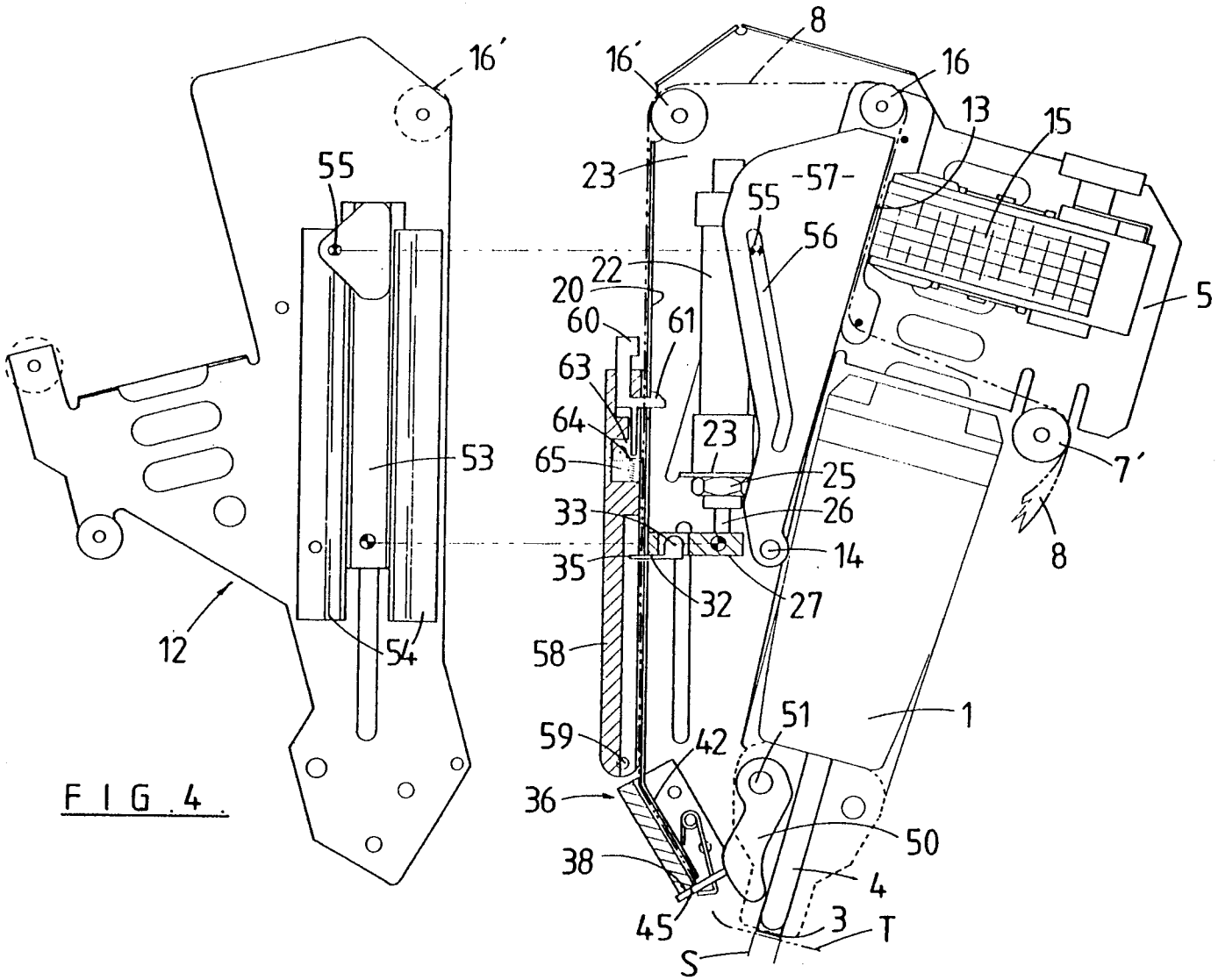
Figure 5:
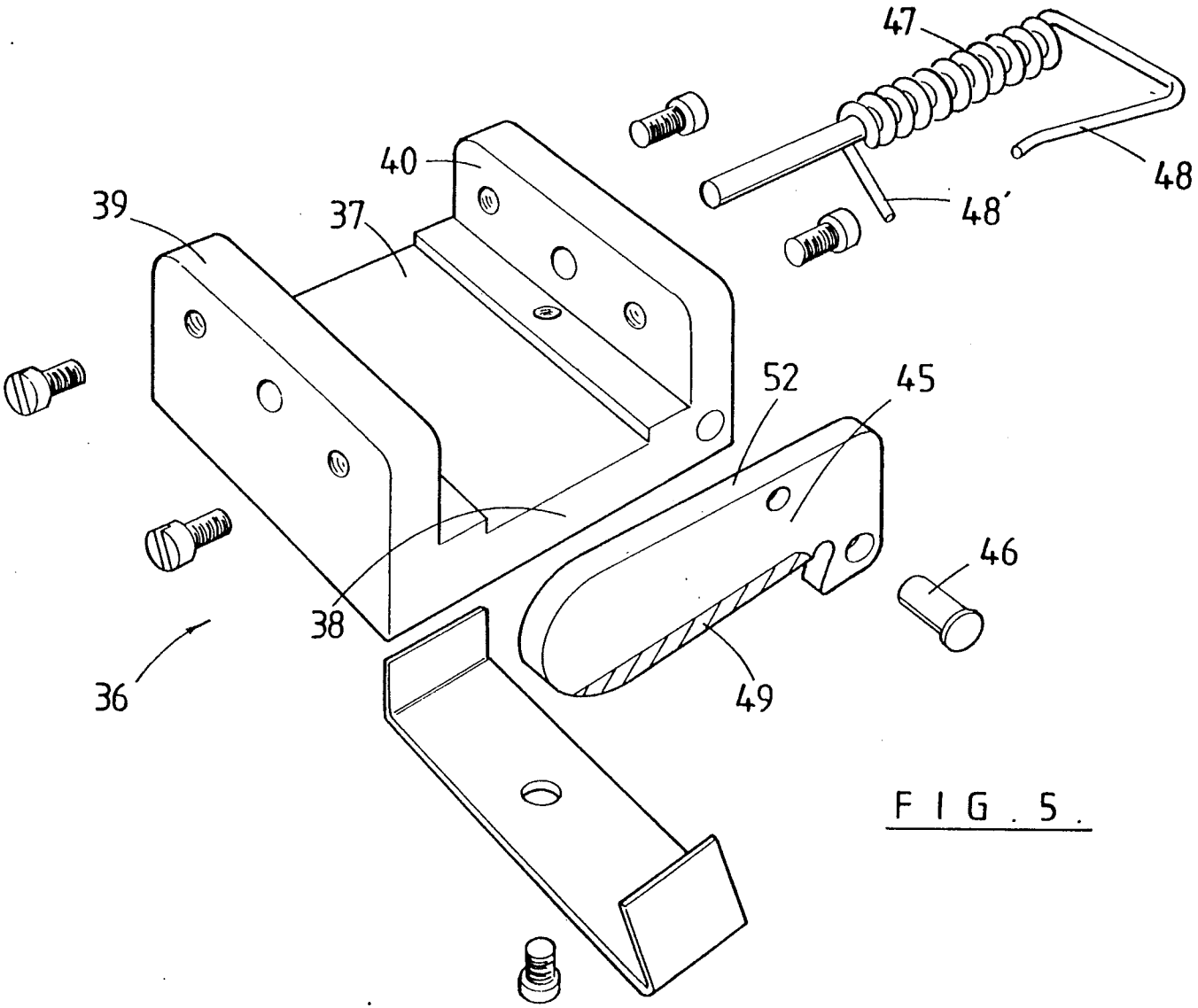
Figure 6:
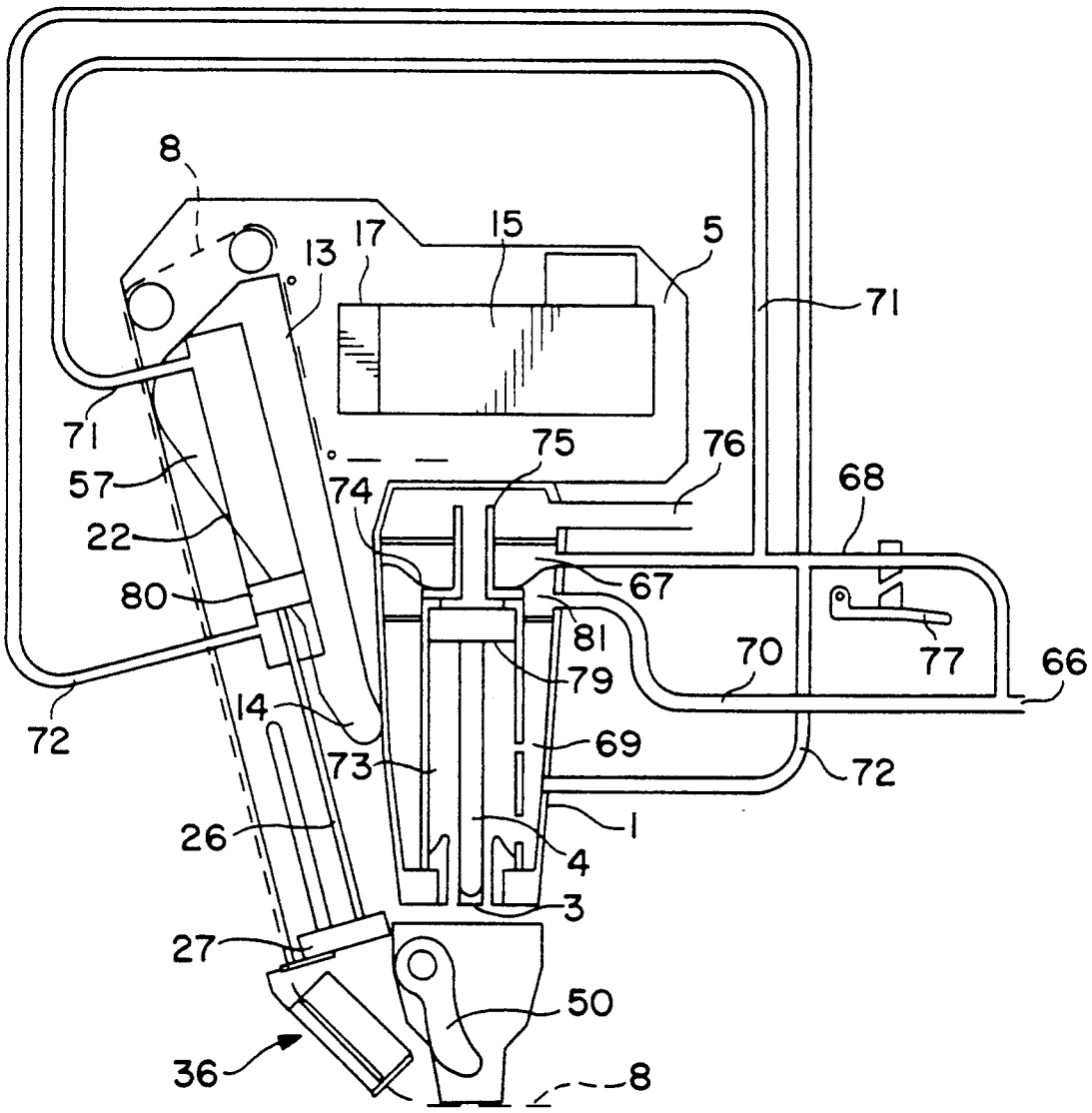
Figure 7:
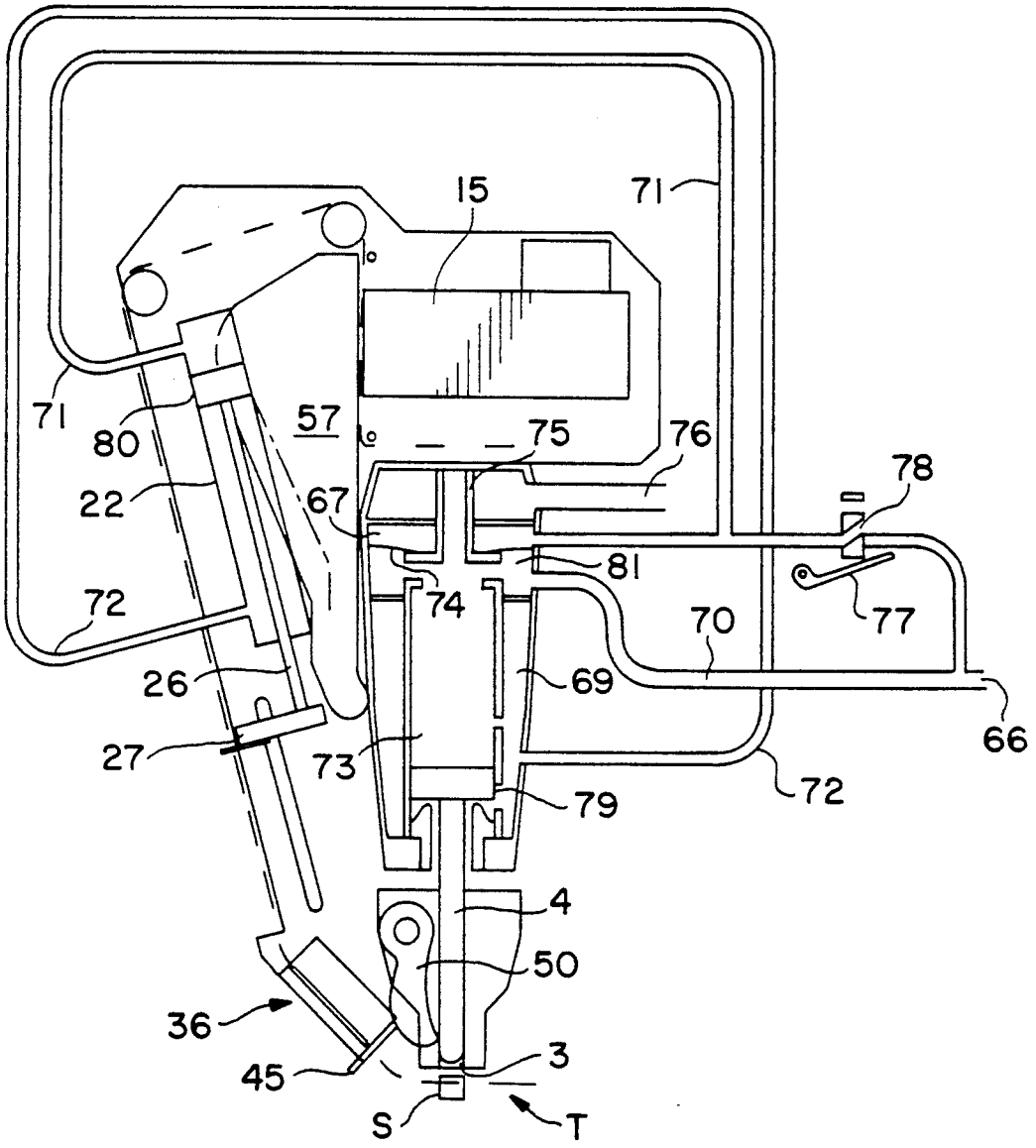

One preferred form of the invention and modifications thereof will now be described with reference to the accompanying drawings in which:

FIG. 1 is an end elevation of apparatus according to the present invention,

FIG. 2 is a side elevation of the apparatus according to the present invention, FIGS. 3 and 4 are end elevations of the apparatus with the end cover plate removed and positioned to one side to show the components used in the feed and indexing mechanism of the apparatus, FIG. 5 is an exploded view of the components in the cutting assembly of the apparatus, and FIGS. 6 and 7 are schematic end elevations which essentially correspond to the apparatus as shown in FIGS. 3 and 4 respectively but show more specifically the pneumatic circuitry.

The preferred embodiment of the invention has been particularly designed to apply marking tabs or labels to timber products such as logs or cut timber to associate a tab or label with appropriate indicia thereon so that the material can be identified, for example as having been satisfactorily treated through a preservation system and of a standard suitable for use as building material. This is one example only of a variety of uses to which the invention can be applied. For example the apparatus could be used to apply tags or labels to wooden, cardboard or foamed or solid plastic boxes/cartons to identify contents or product or similar.

In this embodiment, a hand-held pneumatically operated gun 1 is designed to feed staples from a magazine 2 to a position to be driven by a driving head 3 into the timber surface. The driving head 3 has associated therewith an auxiliary driving head 4 which reciprocates at the same time as the driving head 3 under the action of the pneumatically operated gun 1.

Associated with the gun 1 is a support plate 5 on which is mounted a tape holding spool 6 on which is positioned a reel of tape 8. The tape 8 is preferably of tough durable material and preferably plastics. The tape 8 is held in position by an arm 10 which has an offset oversize opening 11 to allow the arm 10 to be moved transversely and away from under head 9 of a the spool pivot to allow a new reel of tape 8 to be loaded.

Any suitable holding means for a reel of tape could be used in the present invention subject to the requirement that the reel of tape can be readily loaded. The mounting can include means for minimising the likelihood of overrun of the tape from the reel during use. Also a housing can be employed so that the tape is protected from jamming. A magazine holding the tape could also be used to simplify replacement of the tape.

The tape 8 is fed from the reel around rollers 7 and 7' mounted by cover plate 12 and support plate 5 to then pass across a platen 13. This platen 13 is mounted by or formed with a cam 57 pivotally mounted at 14. Thus platen 13 can swing from a "disengaged" position (see FIG. 3) to an "engaged" position (see FIG. 4). In the latter position platen 13 moves into contact with the printing indicia of a printing device 15. The printing device 15 can be a standard printing device and is permanently fixed on plate 5. This simplifies the operation of the present assembly and allows sequenced indicia to be printed onto tape 8 as the tape is moved into association with the printing head using the action of the platen 13 as will be described later.

The tape 8 continues about guide rollers 16 and 16' designed to apply tension to the tape 8 but allow relative movement so that movement of the platen 13 does not cause any forces to be created which are likely to pull upon the tape 8 thereby distorting or causing smudging of the indicia printed by the printing head. Printing device 15 includes an inking roller 17 which is mounted so as to move from a rest position when the platen 13 is against the printing head to the position (shown in FIG. 3) where the roller 17 moves over the printing head to re-ink the head prior to each printing sequence.

Tape 8 continues into a feed and indexing mechanism 19 and passes over a guide plate 20 formed with a mounting plate 23 but located at right angles to the plane of plate 23. Plates 20 and 23 are preferably formed integrally with support plate 5.

The components in the feed and indexing means are best seen in FIGS. 3 and 4. A double acting pneumatic cylinder 22 is supported by mounting plate 23. Pneumatic cylinder 22 is held in place by a mounting nut 25. The operating rod 26 of the cylinder 22 is operatively associated with a feed head 27.

Pivotally associated with feed head 27 is an indexing finger 32 operated against the biasing action of a mounting pin 33 and a coil spring (not shown) so that when feed head 27 is withdrawn finger 32 can pivot forwardly to slide over tape 8 but when feed head 2 is moved forwardly finger 32 will engage with tape 8 to advance the tape 8. Finger 32 preferably incorporates a protuberance 35 which engages within an aperture in tape 8, the aperture being located at indexed distances so that when finger 32 engages in the aperture tape 8 will be advanced a predetermined distance with slippage.

After leaving the feed and indexing mechanism 19 the tape 8 is advanced through a cutting mechanism. The cutting or guillotine assembly 36 is illustrated in an exploded view in FIG. 5. The guillotine assembly 36 has a tape support plate 37 which at its forward edge provides the cutting edge 38. The tape support plate 37 has two side walls 39 and 40 preferably integrally formed and formed from a suitable metal material. A recess 41 is formed in plate 37 for tape 8 to pass. A finger 42 formed as an extension of guide plate 20 locates between walls 39 and 40 and interacts with tape 8 to keep the tape in recess 41. This ensures tape 8 is correctly located below cutting blade 45 prior to it passing over the cutting edge 38. Cutting blade 45 is pivotally mounted on support plate 37 with a pivot 46. A biasing spring 47 mounted on a shaft 44 extending between walls 39 and 40 has a first tail 48 which engages in an aperture in blade 45 and is designed to create a biasing movement holding the blade in the open position. A second tail 48' engages with support plate 37.

The shape of the blade edge 49 relative to the cutting edge 38 is such that as the blade pivots about pivot 46 the shearing action commences at a position remote from pivot 46 and cuts with a shearing action toward the pivot.

It is important to ensure that the cutting assembly can cut tough plastics material at a high frequency operation without fault and with clean cuts. The operating sequence can be, for example up to 140 operations a minute and a malfunction of the cutting means would be a major disadvantage. The cutting action is created through an impact action with the movement of auxiliary driving head 4 travelling the maximum distance prior to cutting action taking place to allow for the greatest possible time in the sequence to advance tape 8. Thus the cutting stroke takes place over a comparatively small movement of the auxiliary driving head 4.

A toggle 50 (see FIGS. 3 and 4) pivotally supported at 51 is impacted, in use, by the auxiliary driving head 4 to apply a pressure to the top 52 of cutting blade 45. This impact action generates force which not only drives cutting blade 45 to the cutting position but also forces cutting blade 45 back against cutting face 38. Blade 45 is guided to its correct position through association with the front faces of walls 39 and 40.

FIG. 3 represents the apparatus in a "ready" position. Upon actuation the apparatus moves to the configuration as shown in FIG. 4. As a consequence drive head 3 drives a staple S through the leading end of tape 8 and as a result of the action of auxiliary driving head 4 cutter mechanism 36 cuts a tab T from tape 8. Additionally feed head 27 is retracted by the action of auxiliary pneumatic cylinder 22. This retraction of feed head 27 results in a cam driver 53 sliding between guides 54 on the inside of cover 12. A cam pin 55 engaged in slot 56 of cam 57 provides the driving force which moves cam 57 about pivot 14 such that platen 13 moves to take up the position shown in FIG. 4.

Drive head 3 may be profiled so that the corners are relieved and the centre portion strikes the staple first thereby creating a depression in the staple and thus preventing it from driving right through the tab when in contact with soft materials.

As the apparatus reverts from the position shown in FIG. 4 to that shown in FIG. 3 protuberance 35 of finger 32 applies a feeding force to tape 8 whereby the leading end of tape 8 will become positioned for application at the next operation of the device.

To maintain tape 8 on guide plate 20 a cover 58 is provided. This cover 58 is hingedly coupled at one end by hinge pin 59 and is releasably retained at its other end by a latch 60 having spaced apart hooked portion 61 which engage in similarly spaced apart apertures 62 in plate 20. Thus cover 58 can be pivoted away from plate 20 to enable tape 8 to be threaded through to the cutter mechanism 36.

Mounted in a recess 63 in cover 58 is a tape stop 64 which is biassed by a spring 65. Thus as the feed head 27 moves from the position in FIG. 3 to that of FIG. 4 the tape stop 64 applies a pressure to tape 8 to prevent it from retracting. However, as feed head 27 moves back to its FIG. 3 position the tape stop 64 pivots (see FIG. 3) to enable the tape 8 to advance under the action of finger 32.

The sequence of events described above can be achieved in a variety of different ways, however, the pneumatic diagrams of FIGS. 6 and 7 disclose one means of achieving the correct sequence.

In FIG. 6 the apparatus is shown at rest. Air under pressure from a pressurised air source (not shown) is connected via line 66. This pressurises diaphragm chamber 67 via line 68 and chamber 81 via line 70. Line 71 pressurises auxiliary cylinder 22 so that the piston 80 is held in the position shown in FIG. 4. Line 72 couples auxiliary cylinder 22 back to cylinder chamber 69. Diaphragm 74 is coupled to a valve element 75 which is drawn off a seat such that the "top" end of main cylinder 73 is vented to atmosphere via vent 76. Piston 79 is thus held at the upper end of cylinder 73. To actuate the gun trigger 77 is operated (see FIG. 7) which vents lines 68 and 71 to atmosphere via passage 78 of trigger 77. Thus a pressure differential is set up which causes piston 79 to move to the "bottom" of cylinder 73 and thereby drive a staple through a tape 8. This also causes toggle 50 to actuate the cutting mechanism to cut a tab T from tape 8. Simultaneously piston 80 of auxiliary cylinder 22 is driven "upwardly" to draw with it feed head 27.

Upon trigger 77 being released the positive pressure applied via lines 71 and 72 causes pistons 79 and 80 to reverse and this results in the equilibrium of FIG. 4 to be reached and thereby complete the operating cycle.

The present preferred embodiment has been described in association with a pneumatic staple gun. It will be understood that the device could be adapted for association with any suitable fastening means that can operate at a fast sequence of operations. In the present case an operator gripping the handle 83 can activate the trigger 77 which commences the sequence of operation. The operator would do this when the gun was in contact with the material such as treated timber to which a tab was to be applied and he would do the application by a sweeping or wiping action so that the stapling and cutting steps take place during such action to thereby leave a single tab stapled to the timber. The user with limited practice is able to develop an aptitude to fix tabs using the present apparatus at a very fast rate.

The present invention is also able to be adapted in a number of different ways. For instance, the fastening means may be provided not by metal staples but by a plastic fastening which can be in the form of a staple or in the form of a single spike passing through the tab. It may also be adapted for automatic operator on a processing line.

The device may also be modified so that the impact head does not deliver a separate fastening means but the fastening means is formed by deforming a section of the tab so that it is embedded in the timber. With this application suitable plastics material in the tab would be utilized.

The preferred embodiment has been described with particular reference to applying a tab to timber products but the apparatus could also be used where it was necessary to produce a reinforcing tab behind the head of a staple that was, for example fixing insulating material to a structural framework.

It should be appreciated that while the preferred embodiment has been described with reference to a pneumatic operation. The componentry that has been illustrated in the drawings could have the same operating sequence created using an electrically operated gun or a hand powered stapler equipped with suitable mechanics.

What I claim is:

1. Apparatus comprising a housing, impact means associated with said housing and operable to deliver a penetrating fastening means into a surface, feed means to feed a strip of material from which a tab is to be cut, cutting means to separate the tab from the strip, means to present the tab to a position where it can be brought into contact with the surface and by impact contact of said penetrating fastening means by said impact means fasten the tab to said surface, and engagement means moved by and as a consequence of movement of the impact means along a line of movement to engage with and thereby cause said cutting means to operate to separate the tab from the strip.

2. Apparatus as claimed in claim 1 wherein the impact means is adapted to deliver a staple and form a depression in the staple.

3. Apparatus as claimed in claim 1 including an indexing mechanism to deliver a substantially constant length of strip through said cutting means upon each operation of the apparatus.

4. Apparatus as claimed in claim 3 wherein the indexing means includes a linear actuator drivingly engaged with an indexing finger, said finger being mounted to engage with and move said strip as the linear actuator moves in a first direction and to freely move over said strip as the linear actuator moves in a reverse direction.

5. Apparatus as claimed in claim 4 further including printing means to apply printed indicia to a portion of said strip and a movable strip support surface, the movable support surface supporting said strip thereon and being drivingly coupled to said linear actuator whereby the movable support surface moves the strip thereon into contact with said printing means as the linear actuator moves in said reverse direction.

6. Apparatus as claimed in claim 3 further including printing means operable to apply printed indicia to a portion of said strip in conjunction with said delivery and cutting of said strip to form a tab.

7. Apparatus as claimed in claim 1 wherein the engagement means engages with the cutting means to cause the cutting means to impact cutting a shearing and impact action to said strip.

8. Apparatus as claimed in claim 7 wherein the engagement means is a pivotally mounted toggle having a first portion engageable with said impact means and a second portion engageable with a cutting blade forming part of said cutting means.

9. Apparatus as claimed in claim 8 wherein said second portion is shaped to engage with the cutting blade to generate a force to press the cutting blade against the cutting edge.

10. Apparatus as claimed in claim 8 wherein the impact means is a driving head, there being an auxiliary driving head mounted to move therewith and engage with said first portion of the toggle.

11. Apparatus as claimed in claim 1 wherein the means to present includes a strip support over which said strip can pass, said strip support being located on an incline toward said line of movement.

12. Apparatus as claimed in claim 11 wherein the cutting means comprises said strip support, a cutting edge over which said strip is advanced and a cutting blade operably associated with the cutting edge.

13. Apparatus as claimed in claim 1 wherein the impact means is driven by a primary pneumatic cylinder, there being an auxiliary pneumatic cylinder coupled to an indexing mechanism to deliver a substantially constant length of strip through said cutting means upon each operation of the apparatus, said auxiliary pneumatic cylinder being coupled to pressurized air lines of the primary pneumatic cylinder and valve means, whereby operation of said primary cylinder to drive said impact means causes operation of said auxiliary pneumatic cylinder to occur.

14. In a stapling apparatus comprising a staple gun having a primary pneumatic cylinder drivingly cooperating with impact means, a housing incorporating feed means for feeding a strip of material, cutting means operable to cut a portion of material from said strip to form a tab, and means to present said portion of the strip to a position where it can be brought into contact with a surface and fastened thereto by a staple driven therethrough by said impact means, said feed means including an auxiliary pneumatic cylinder coupled directly to said primary pneumatic cylinder whereby operation of said primary pneumatic cylinder causes operation of said auxiliary cylinder to occur.

15. Apparatus as claimed in claim 14 further including engagement means moved by and as a consequence of movement of the impact means along a line of movement to engage with and thereby cause said cutting means to operate to separate the tap from the strip.

16. Apparatus as claimed in claim 14 wherein the engagement means is a pivotally mounted toggle having a first portion engaging with said impact means and a second portion engageable with a cutting blade forming part of said cutting means.

17. Apparatus as claimed in claim 14 further including an indexing finger drivingly engaged with said linear actuator and the strip support surface movably mounted adjacent a printing means, said auxiliary pneumatic cylinder being drivingly engaged with said indexing finger and movable strip support surface, whereby upon operation of the auxiliary pneumatic cylinder in a first direction, said indexing finger moves aid strip and in a second direction causing said strip supported by said movable support surface to be moved into contact with said printing means.

* * * * *